United States Patent [19]

Karliner

[11] 4,022,381

[45] May 10, 1977

[54] AIRLESS SPRAY APPARATUS

[76] Inventor: Rudolf R. Karliner, 10145 Lloy Ave., Portage, Mich. 49081

[22] Filed: Nov. 24, 1975

[21] Appl. No.: 634,458

[52] U.S. Cl. ..... 239/126; 239/127; 239/526; 417/311; 417/388

[51] Int. Cl.[2] ..... B05B 9/00

[58] Field of Search ..... 417/280, 383, 388, 307, 417/311; 239/126, 127, 526, 600

[56] References Cited

UNITED STATES PATENTS

| | | | |
|---|---|---|---|
| 3,246,845 | 4/1966 | Techler et al. | 239/126 UX |
| 3,433,161 | 3/1969 | Vetter | 417/388 |
| 3,680,981 | 8/1972 | Wagner | 417/388 X |
| 3,767,326 | 10/1973 | Hetz | 417/383 X |
| 3,827,827 | 8/1974 | Hill | 239/126 X |
| 3,913,844 | 10/1975 | Petrovic | 239/600 |

*Primary Examiner*—John J. Love
*Attorney, Agent, or Firm*—Woodard, Weikart, Emhardt & Naughton

[57] ABSTRACT

A fluid spraying apparatus, such as for use in paint spraying and the like, including a high pressure diaphragm pump, a safety and pressure adjustment valve system, and a high pressure safety spray gun. The valve system includes a valve for maintaining a desired pressure relationship between the sprayed fluid side of the system and the pumping fluid section of the high pressure diaphragm pump. The high pressure safety gun includes a pressure-responsive locking barrel portion which prevents access to the spray tip while the fluid being sprayed is under pressure.

11 Claims, 3 Drawing Figures

AIRLESS SPRAY APPARATUS

BACKGROUND OF THE INVENTION

1. Field of the Invention

The invention is in the field of dispensing apparatus.

2. Description of the Prior Art

Typical prior art pumps presently available, especially for use in airless spraying, are shown in U.S. Pat. No. 3,680,981 to Wagner and U.S. Pat. No. 3,788,554 to Guise. Several patents disclose an interaction between the driven fluid pressure and the pumping fluid section of a diaphragm pump. The consideration in these systems has been to use the driven fluid pressure to control a valve for returning hydraulic fluid to the sump. The purose for this is to reduce the loading and wear on the pump. Such systems are shown in U.S. Pat. No. 2,971,465 to Cailland, No. 2,753,805 to Boivinet, No. 3,433,161 to Vetter, No. 3,416,453 to Feuillebois, and No. 3,411,673 to Mann. Mann also shows a system wherein the driven fluid inlet check valve is opened in response to high driven fluid output pressure rather than affecting the hydraulic side of the pump system. U.S. Pat. No. 1,651,964 to Nelson shows a compressed air output controlling the hydraulic fluid return in a diaphragm pump. In U.S. Pat. 3,775,030 to Wanner, fluid output pressure controls a valve which returns fluid to the inlet of the pump.

None of the above patents apprehend the use of hydraulic section pressure to control or unload the driven fluid side of the system. In the past many injuries have occurred while the driven fluid section of an airless spraying unit was pressurized, even after the power to the motor was disconnected, from an operator attempting to perform maintenance on the unit, and therefore there has been a need for means for automatically depressurizing the driven fluid section of the system.

A fluid dispensing gun having some pressure-responsive valve stem movement is shown in U.S. Pat. No. 3,410,491 to Malec. Malec, however, does not disclose a safety gun mechanism responsive to pressure as set forth herein.

SUMMARY OF THE INVENTION

This invention relates to a diaphragm pump having a pumping fluid chamber and a driven fluid chamber, a diaphragm separating the chambers, inlet and outlet passages to the driven fluid chamber, and drive means for alternately pressure loading and unloading pumping fluid in the pumping fluid chamber, the improvement which comprises a first valve means responsive to the pumping fluid chamber pressure for varying driven fluid pressure in communication with the outlet passage of the driven fluid chamber.

It is an object of the present invention to provide a pump spray unit containing various safety features to prevent accidental injuries to the user.

It is a further object of the present invention to provide such a pump unit with a safety valve system which will unload the complete system of its pressure after the power to the motor is shut off.

It is a still further object of the present invention to provide such a pump apparatus with a safety gun which will not allow the user of the apparatus to remove the spraying tip from the gun while the system is pressurized.

Another objective is to provide such a pump unit with an automatic priming valve.

A further object is to provide such a pump with a valve which will allow the pump to start always under a no-loading condition.

A still further object is to provide such a pump unit with a valve which will automatically adjust the pressure at the driven fluid section proportionally to the pressure setting at the hydraulic section in both directions.

Further objects and advantages of the present invention shall be apparent from the following detailed description in conjunction with the accompanying FIGURES.

DESCRIPTION OF THE PREFERRED EMBODIMENT

Figure 1:
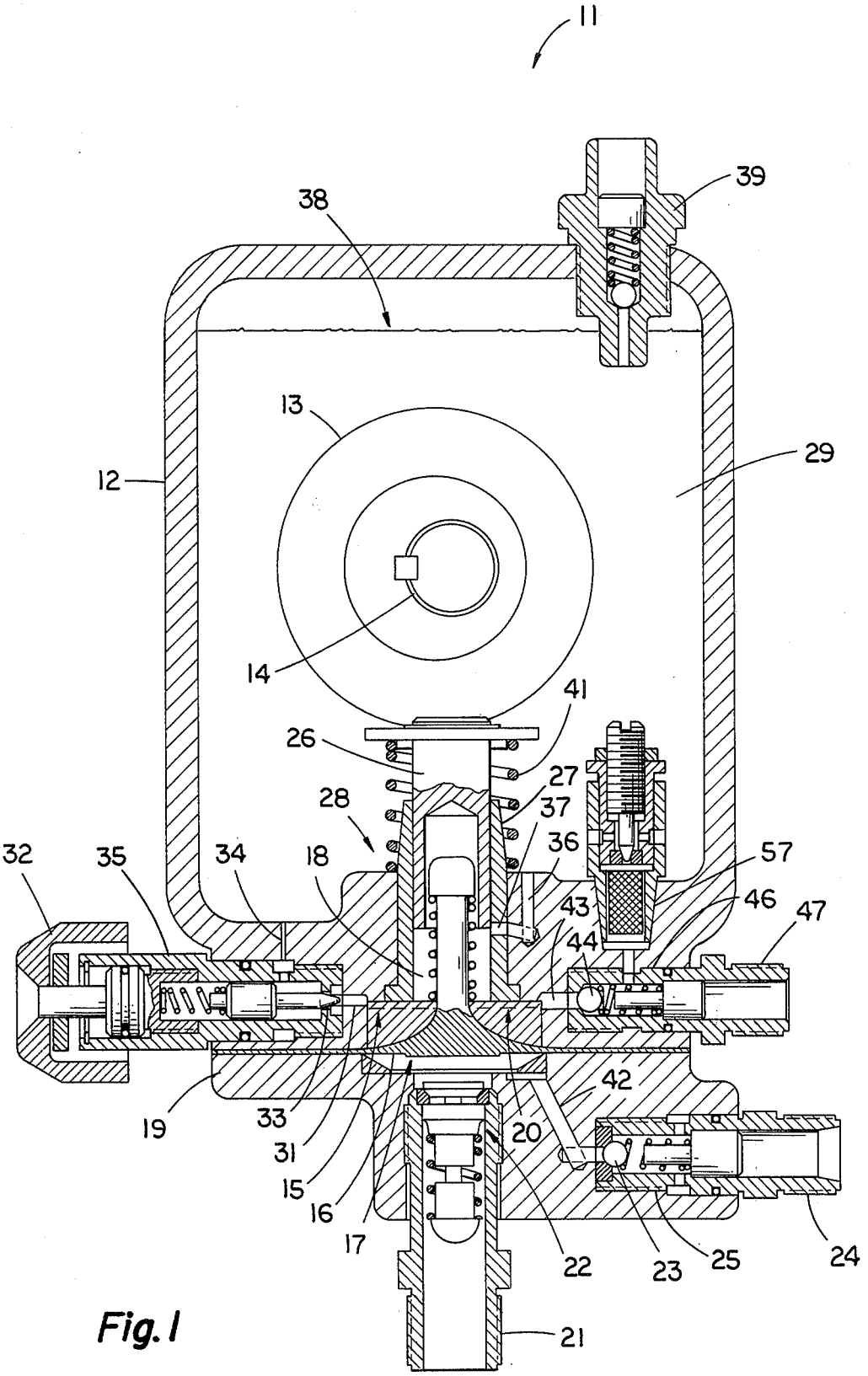
FIG. 1 is a diagrammatic vertical cross-sectional view through a pump apparatus according to the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring in particular to FIG. 1 there is shown a diaphragm pump 11 according to the present invention. Pump 11 comprises a casing 12 and an eccentric bearing 13 driven by shaft 14 and a motor (not shown). A pumping chamber 17 is defined between a diaphragm 16 and pump body member 19 which is rigidly attached to housing 12. A pumping chamber 18 for hydraulic fluid or the like is defined by diaphragm 16 and cylinder 27 and piston 26.

Fluid to be sprayed such as paint is supplied from a container, positioned below pump 11, through inlet line 21. A check valve 22 is provided in line 21 to permit flow of the liquid only into chamber 17. The pressurized paint is discharged through an outlet check valve 25 including check ball 23 in line 24 to a supply hose (not shown) which couples the pressurized liquid to a connector such as 25 of the spray gun of FIG. 3. As shall be described hereinafter, the spray gun has a control valve throttling or completely stopping flow from the pumping chamber 17.

Diaphragm 16 is axially moveable with driving pressure intermittently applied and relieved by means of hydraulic fluid in chamber 18. This driving pressure is provided by a piston pump generally identified as 28 and including a cylindrical chamber 27 slideably receiving a cylindrical piston 26 driven by eccentric drive bearing 13 rotated by a driving motor (not shown).

The eccentric bearing 13 rotates in housing 12 for the driving fluid 29. Driving fluid 29 communicates with the driving fluid pressure chamber 18 behind the diaphragm 16 by means of an overflow passage 31 containing an adjustable pressure limiting valve 35 and also by means of a refill passage 36. Adjusting valve 35 has a threadedly received control knob which determines the spring force with which needle 33 is held in the end of passageway 31. A return opening 34 to the sump is provided for hydraulic fluid flowing from pumping chamber 18 through passage 31 and past needle 33. When the pumping chamber pressure exceeds that set by knob 32, hydraulic fluid returns to the sump by way of passages 31 and 34.

A refill passage 36 and a refill slot 37 in the cylindrical chamber 27 are provided. The slot 37 is uncovered by the piston 26 only at the end of the suction stroke of the piston and is otherwise closed by the piston 26. Any loss of driving fluid by leakage past the piston 26 is replenished on each driving stroke through the refill slot 37 and refill passage 36 communicating with the liquid 29 in the sump. The housing 12 is partially filled with the driving fluid 29 to a driving level as indicated at 38, and the top of the chamber is vented to the atmosphere by means of a relief valve 39.

A spring 41 urges the piston 26 against the eccentric bearing 13. The eccentric bearing 13 drives the piston 26 through a predetermined distance, and this reciprocation of the piston drives the fluid 29 in pumping fluid chamber 18 ahead of the piston forcing the diaphragm 16 to flex. This results in the pumping of the driven fluid in chamber 17 with liquid being drawn in through line 21 and check valve 22 on an upstroke of piston 26 and with liquid being forced out through line 42, check valve 25 and line 24 on a down stroke of piston 26.

Figure 2:
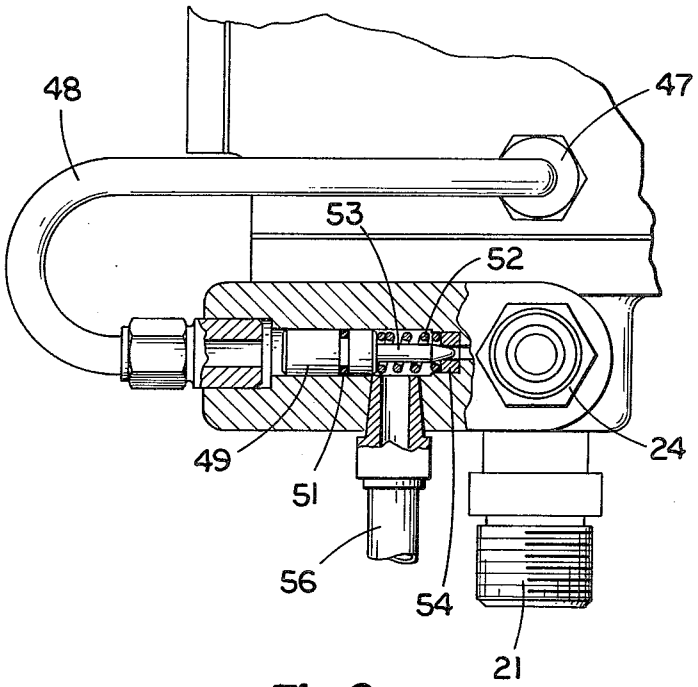
FIG. 2 is a side view of a portion of the apparatus of FIG. 1.

Also during operation of the pump, fluid flows through a groove 20 and passage 43 unseating ball 44 of check valve 46. Pumping fluid then flows through line 47, tube 48 (FIG. 2), and to plunger 49 which contains seal 51 to prevent further passage of the hydraulic fluid. The plunger is balanced by a spring 52, and if the hydraulic pressure exceeds the spring force of spring 52, the plunger 49 moves toward seat 54, needle 53 of plungerr 49 closing the opening in seat 54. The opening in seat 54 communicates with the pumped fluid output line 24 and with the pumped fluid container through a bypass line 56, which allows pumped fluid moving past the opening in seat 54 to return to the driven fluid container. When needle 53 closes the opening in seat 54, pressure builds up proportionally, and the difference in area (between the head of needle 53 in the opening in seat 54 being acted upon by the pumped fluid pressure and the rear portion of plunger 49 being acted upon by the hydraulic fluid pressure) prevents the unseating of needle 53 of plunger 49 from the opening in seat 54 during normal operation of the pump.

Only if the pressure is adjusted at adjustable valve 35 to the minus side, lowering the hydraulic fluid pressure, will the needdle of the plunger disengage from seat 54 to release enough liquid from line 24 to keep the pressure in proportion. In operation, the operating pressure for the hydraulic fluid section is determined by the setting of valve 35. Once the pressure in pumping fluid chamber 18 exceeds the pressure that is set with adjustable valve 35, needle 33 unseats providing a return path for the hydraulic fluid to the sump through opening 34. If the pressure at valve 35 is adjusted toward the minus side, the force exerted on plunger 49 from outlet line 24 becomes greater than the force on the back side of the plunger from the hydraulic fluid side, and the plunger moves briefly to the left unseating needle portion 53 of the plunger equalizing the forces on both sides of the plunger.

If the power to the motor driving shaft 14 is shut off, the compressed fluid in line 48 is free to discharge through an adjustable restricted orifice valve 57 which is located in the pump housing 12 and communicates directly between the check valve 46 and the fluid 29 in the reservoir within housing 12. As the hydraulic fluid seeps off through the restricted orifice valve 57, the spring force of spring 52 and pressure in line 24 starts to move the plunger 49 and its needle portion 53 away from the seat 54 and creates a free communication between line 24 and the liquid container through line 56. All pressure in the complete system is released and will remain so until the motor is once again turned on. During normal operation, restricted orifice valve 57 does not pass a significant amount of fluid at operating pressures due to its small passage size.

At the time the motor is reactivated, the spring force of spring 52 is great enough to allow the pump to prime itself. Once recirculation of the driven fluid by the pump occurs, the pressure builds up in lines 47 and 48 and overcomes the spring force of spring 52. At this time, the system is once again pressurized. Thus, the pump is self-priming as well as automatically unloading the driven and driving fluid lines and permitting pressure adjustments from the hydraulic side.

Figure 3:
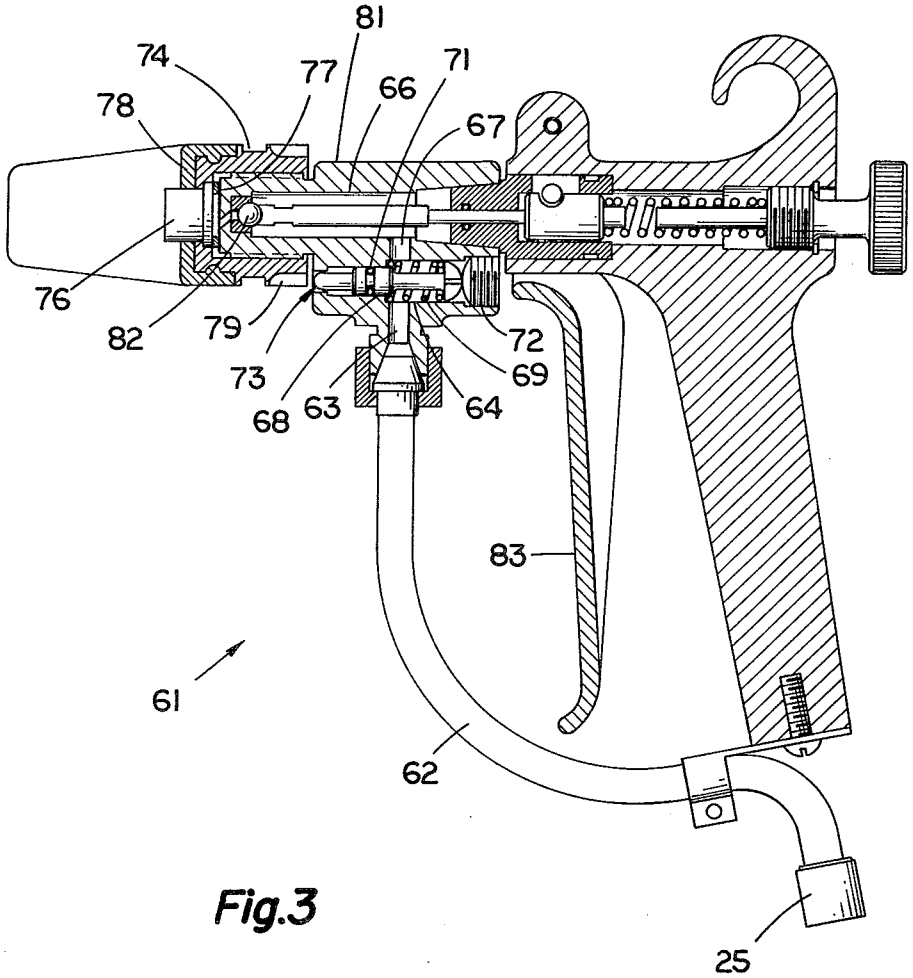
FIG. 3 is a diagrammatic cross-sectional view of a spray gun according to the present invention.

Referring now to FIG. 3, there is shown a spray gun 61 which receives the output of fluid to be sprayed from line 24 at connector 25. The driven fluid is thereupon conveyed through tube 62, through inlet passage 63 and into safety piston chamber 64. The pumped fluid also enters spray chamber 66 through passage 67. The pressurized fluid such as paint in pressure chamber 64 acts at the back side of spring returned piston 68, overcomes the spring force of spring 69, and moves the piston 68 toward the front of the pressure chamber 64. The front part of the pressure chamber is sealed off from liquid flow by an 0 ring seal 71 which is mounted on piston 68, while the rear side of the pressure chamber 64 is sealed off by a plug 72.

The front part 73 of piston 68 is shaped so as to act as an engagement plunger. When the piston 68 moves forward, end 73 engages with a safety cap 74 in which is mounted the spraying tip 76 and a washer 77. Also mounted on cap 74 is a safety extension 78 which is free to be rotated. When chamber 64 is pressurized, piston 68 moves forward in the chamber and end portion 73 is engaged within one of a plurality of notches or recesses 79 circumferentially arrayed in cap 74. Cap 74 is threadedly received on gun body 81 and therefore with piston portion 73 retained within recess 79, it is impossible to remove the cap from the gun. If a recess 79 is not initially aligned with end 73, the first rotation of cap 74 to unscrew it results in end 73 moving into a recess.

When chambers 64 and 66 are pressurized and filled with the fluid to be sprayed, not only is the front portion 73 of piston 68 engaged within one of recesses 79, but also ball 82 blocks the outlet passage preventing the spraying of the fluid unless trigger 83 is depressed, moving ball 82 to the right as is well known. The safety piston 68 prevents removal of the spray tip while the interior of chamber 66 is pressurized so that access to the end of the spray gun body in the vicinity of ball 82 is prevented. Therefore, a user of the gun will not be exposed to an accidental high pressure discharge of sprayed liquid in attempting to, for example, clean an obstruction from the gun tip.

When the sprayer is deactivated, as has been described above, the pressure quickly unloads on the sprayed fluid side of the system, and chamber 64 and 66 consequently depressurize. With the depressurization of chamber 64, the action of spring 69 retracts locking end 73 of piston 68 from recess 79, permitting the removal of the spray tip from the spray gun 61. This is now safe since chamber 66 is consequently also depressurized at this time, and cleaning or other manipulation of the spraying end of gun 61 may be performed safely.

Referring back to FIG. 1, additional pumps of higher or lower pressure may additionally be operated from eccentrically mounted bearing 13 such as by mounting within either side wall of housing 12. A set of valves such as 22, 23, 35, 46 and 57 associated with the above-described pump may be provided for each of such additional pumps. Further, the unloading mechanism illustrated in FIG. 2, may be made a part of each of the additional pump systems. For example, a high volume utility pump may be added to apparatus 10 along the right side wall for use in pumping washing liquids.

While there have been described above the principles of this invention in connection with specific apparatus, it is to be clearly understood that this description is made only by way of example and not as a limitation in the scope of the invention.

What is claimed is:

1. In a diaphragm pump having a pumping fluid chamber and a driven fluid chamber, a diaphragm separating the chambers, inlet and outlet passages to the driven fluid chamber, and drive means for alternately pressure loading and unloading pumping fluid in the pumping fluid chamber, the improvement which comprises:

first valve means responsive to the pumping fluid chamber pressure for varying driven fluid pressure in communication with the outlet passage of the driven fluid chamber.

2. The improvement of claim 1 in which the first valve means includes:

a pressure chamber coupled to the pumping fluid chamber by a first passageway;

check valve means for permitting essentially unidirectional flow of fluid from the pumping fluid chamber to said pressure chamber; and a valve member, slideably mounted within the pressure chamber, having a first portion operable to open or close a pressure relief passageway coupled to the outlet passage from the driven fluid chamber.

3. The improvement of claim 2 which further comprises a pumping fluid sump and a restricted orifice return from the pressure chamber to the sump whereby, when the pressure in the pressure chamber is not replenished through the check valve means from the pumping fluid chamber, the pressure in the pressure chamber decreases as pumping fluid returns to the sump through the restricted orifice valve, the valve member releasing the pressure in the outlet passage of the driven fluid chamber.

4. The improvemet of claim 3 which further comprises a pumping fluid pressure control valve intervening between a passage from the pumping fluid chamber and a return passage to the sump and operable to permit flow through said passages from the pumping fluid chamber to the sump during pressure loading by the drive means when the pumping fluid chamber pressure exceeds a preselected pressure.

5. The improvement of claim 4 in which the valve member includes a first portion slideably received in the pressure chamber and presenting a rear face acted upon by the pressure in the pressure chamber and a second needle portion received on a valve seat in sealing engagement, the valve seat being at the end of a passageway in communication with the outlet passage of the driven fluid chamber, the needle portion within the valve seat being acted upon by the driven fluid outlet pressure, whereby varying the pumping fluid chamber pressure with the pressure control valve results in momentary movement of the valve member moving its needle portion away from the valve seat releasing a proportionate amount of pressure from the driven fluid outlet passage.

6. The improvement of claim 5 in which the inlet and outlet passages to the driven fluid chamber include an inlet and outlet check valve, respectively.

7. The improvement of claim 1 in which said first valve means includes a pressure relief passageway coupled to the outlet passage of the driven fluid chamber, said first valve means varying driven fluid pressure by directing driven fluid to pass from the driven fluid chamber through the pressure relief passageway.

8. In a diaphragm pump having a pumping fluid chamber and a driven fluid chamber, a diaphragm separating the chambers, inlet and outlet passages to the driven fluid chamber, and drive means for alternately pressure loading and unloading pumping fluid in the pumping fluid chamber, the improvement which compises:

first valve means responsive to the pumping fluid chamber pressure for varying driven fluid pressure in communication with the outlet passage of the driven fluid chamber;

a spray gun body having a spray chamber and also having an auxiliary chamber in communication with the spray chamber, said spray gun body further having a nozzle end, the outlet passage of the driven fluid chamber being coupled to the spray chamber;

means for coupling the pressurized driven fluid to the spray chamber and the auxiliary chamber;

nozzle means for selectively dispersing fluid from the spray chamber;

a cover member, threadedly received on the nozzle end of the spray gun body, including a plurality of circumferentially arrayed recesses;

a plunger member, slideably received within an end of the auxiliary chamber, having a rear portion acted upon by the pressure in the auxiliary chamber and having a front pin portion operable to be received within one of the recesses when the auxiliary chamber is pressurized moving the plunger to an end of the auxiliary chamber; and return means for moving the plunger from the end of the chamber and retracting the pin portion from said recess when the auxiliary and spray chambers are depressurized.

9. The improvement of claim 8 in which the first valve means includes:

a pressure chamber coupled to the pumping fluid chamber by a first passageway;

check valve means for permitting essentially unidirectional flow of fluid from the pumping fluid chamber to said pressure chamber; and a valve member, slideably mounted within the pressure chamber, having a first portion operable to open or close a pressure relief passageway coupled to the outlet passage from the driven fluid chamber.

10. The improvement of claim 9 in which the valve member includes a first portion slideably received in the pressure chamber and presenting a rear face acted upon by the pressure in the pressure chamber and a second needle portion received on a valve seat in sealing engagement, the valve seat being at the end of a passageway in communication with the outlet passage of the driven fluid chamber, the needle portion within the valve seat being acted upon by the driven fluid outlet pressure, whereby varying the pumping fluid chamber pressure with the pressure control valve results in momentary movement of the valve member, moving its needle portion away from the valve seat and releasing a proportionate amount of pressure from the driven fluid outlet passage.

11. A spray gun apparatus comprising:

a spray gun body;

means for coupling pressurized fluid to a spray chamber and an auxiliary chamber in communication with the spraying chamber in the spray gun body;

nozzle means for selectively dispersing fluid from the spray chamber;

a cover member, threadedly received on a nozzle end of the spray gun body, including a plurality of circumferentially arrayed recesses;

a plunger member, slideably received within an end of said auxiliary chamber, having a rear portion acted upon by the pressure in the auxiliary chamber and having a front pin portion operable to be received within one of said recesses when the auxiliary chamber is pressurized moving the plunger to an end of the auxiliary chamber; and return means for moving the plunger from the end of the chamber and retracting the pin portion from said recess when the auxiliary and spraying chambers are depressurized.

* * * * *